US009248894B1

(12) United States Patent
Jacquemin

(10) Patent No.: US 9,248,894 B1
(45) Date of Patent: Feb. 2, 2016

(54) CONTROLLED CORROSION RELEASE SYSTEM

(71) Applicant: Joseph W. Jacquemin, Panama City Beach, FL (US)

(72) Inventor: Joseph W. Jacquemin, Panama City Beach, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 271 days.

(21) Appl. No.: 13/944,383

(22) Filed: Jul. 17, 2013

(51) Int. Cl.
*B63G 8/00* (2006.01)

(52) U.S. Cl.
CPC ..... *B63G 8/00* (2013.01); *C23F 2213/20* (2013.01)

(58) Field of Classification Search
CPC ..... C23F 13/04; C23F 13/02; C23F 13/06; C23F 13/10; C23F 2213/10; C23F 2213/30; C23F 2213/20; B63G 8/00–8/42
USPC ..... 114/312–342; 204/196.01, 196.02, 204/196.37; 205/724, 729, 740
See application file for complete search history.

(56) References Cited

PUBLICATIONS

Hori et al (Machine Translation of JP 2006-030124).*

* cited by examiner

*Primary Examiner* — Edna Wong
*Assistant Examiner* — Alexander W Keeling
(74) *Attorney, Agent, or Firm* — James T. Shepherd

(57) ABSTRACT

A controlled corrosion release system for a payload is provided. The payload is submerged in a conductive medium, such as seawater. The system includes clips which restrain the payload against a housing. A circuit is established to allow electrical current to flow from a power source contained within the housing, through the clips which serve as anodes, through the seawater, into the housing which serves as a cathode, and back to the power source. Accordingly, the clips corrode and weaken structurally. The clips eventually fail and the payload is released. The time for release is proportional to the power supplied, such that the release time can be controlled.

19 Claims, 4 Drawing Sheets

CONTROLLED CORROSION RELEASE SYSTEM

STATEMENT OF GOVERNMENT INTEREST

The invention described herein may be manufactured and used by or for the Government of the United States of America for governmental purposes without the payment of any royalties.

BACKGROUND OF THE INVENTION (1) Field of the Invention

The present invention relates to release systems. More particularly, the present invention relates to controlled corrosion release systems for underwater payloads.

(2) Description of the Prior Art

A number of applications require the placement of a payload in an underwater environment. Typically, the payload is buoyant and is attached to an anchor that holds the payload underwater. After a period of time, the payload is released from the anchor and rises to the surface. The well-known options for securing and subsequently releasing the payloads from the anchor in these applications include constant corrosion releases, mechanical releases utilizing a motor/actuator, or burn wire releases.

A constant corrosion release starts corroding the moment it is emplaced. Therefore, with this method the actual moment of release cannot be changed. Also, the mechanical strength of the restraining member that forms the release will necessarily decrease, as this restraining member must also be the corroding member. Additionally, the corrosion release cannot be guaranteed to release when desired.

A mechanical release requires more volume for an actuator and more complexity and cost. This type of release will have a lower reliability and does not have an efficient or practical fail-safe release feature should the mechanical release fail to operate. A burn-wire release burns through a tensioned wire, releasing the pay load item. This method requires a more complex mechanism overall and has limited holding strength. As in the case of a mechanical release, a burn wire release does not have a fail-safe release feature. If the mechanism for initiating the burn-wire fails, the payload will not be released.

Thus, a need has been recognized in the state of the art to provide a release mechanism that reduces both complexity and costs, while increasing reliability. There is also a need to provide a release mechanism that includes a fail-safe feature, i.e., the release mechanism should eventually release the payload regardless if the primary release mechanism fails.

As in the case of a mechanical or burn-wire release, the payloads need to be released within a predetermined time after the release command is issued. Additionally, there is a need to provide a release mechanism that requires a small amount of volume to implement, while being able to vary the holding strength of the mechanism.

SUMMARY OF THE INVENTION

It is therefore a general purpose and primary object of the present invention to provide a controlled corrosion release system for a payload submerged in a conductive medium, such as seawater. The system includes one or more clips, which restrain the payload against a housing. A majority of the clips are anodes and the housing serves as a cathode. A power source is contained within the housing and is wired to the anodes and cathode.

When a release command is given, electrical current passes from the power source, through the anodes, into the medium and to the cathode. The anodes are oxidized in the solution, with the ions formed in the process being deposited on the cathode. Accordingly, the anodes erode and dissolve and weaken structurally. The anodes eventually fail and the payload is released. Typically, the payload is positively or negatively buoyant and the buoyant force of the payload accelerates the failure of the anodes as they weaken. The time for release is proportional to the power supplied, such that the release time can be controlled.

The system provides a simple and reliable means for releasing a payload. There are no complex mechanical linkages that are subject to corrosion and failure. Additionally, the system provides a fail-safe mechanism in that the anodes corrode over time even when no current is applied between the anodes and the cathode.

In one embodiment, a payload release system includes a housing, one or more clips attached to the housing, and a retaining ring secured to the clips. The payload is secured to the retaining ring and the housing maintains the payload submerged in a medium.

The system also includes a power source contained within the housing. A positive terminal of the power source is connected to a majority of the clips and a negative terminal of the power source is connected to the housing. The power source, the connected clips, the medium and the housing form a circuit. A controller is disposed within the circuit, wherein corrosion of the connected clips is proportional to a current modulated by the controller and flowing in the circuit.

In one embodiment, the clips connected to the power source are, in the absence of the medium, electrically isolated from the housing. Corrosion of the connected clips is confined to an end portion of each of the clips that abut the retaining ring. The end portion overlaps the retaining ring so as to resist the buoyancy of the payload. The end portion can have a sloped face, which abuts a complementary sloped face of the retaining ring.

In one embodiment, the housing can include a body portion to which the clips are attached. The housing also includes a lid. The power source is contained within a cavity formed between the body portion and the lid. The lid is sealed against the body portion and sealed against intrusion of the medium into the cavity.

In one embodiment, each of the connected clips includes a connection element attached to the clip and penetrating through the body portion into the cavity to connect to the positive terminal. An insulating layer can be secured between each connected clip and the body portion.

In one embodiment, a controlled corrosion payload release system includes a housing having a negative buoyancy, and one or more clips attached to the housing. The payload is secured to the clips and the housing maintains the payload submerged in a medium. A power source is contained within the housing.

A positive terminal of the power source is connected to a majority of the clips and a negative terminal of the power source is connected to the housing. In the absence of the medium, the clips connected to the power source are electrically isolated from the housing. The system also includes a controller, wherein corrosion of the connected clips is proportional to a current modulated by the controller. The current flows from the positive terminal to the connected clips, through the medium, to the housing and returns to the negative terminal.

In one embodiment, the housing includes a body portion, with the clips being attached to the body portion. The housing also includes a lid. The power source is contained within a cavity formed between the body portion and the lid. The lid is sealed against the body portion and sealed against intrusion of the medium into the cavity.

In one embodiment, each of the connected clips includes a connection element attached to the clip. The connection element penetrates through the body portion into the cavity to connect to the positive terminal. The clips include an end portion having a sloped face that overlaps a complementary sloped face of the payload so as to resist the buoyant force of the payload. The corrosion of the connected clips can be confined to their respective end portions.

In one embodiment, the system includes an insulating layer secured between each of the connected clips and the body portion. The system can also include a first seal about the connection element and disposed between each connected clip and the insulating layer, and a second seal about the connection element and disposed between the insulating layer and the body portion. The first and second seals prevent intrusion of the medium about the connection elements and into the cavity.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals and symbols designate identical or corresponding parts throughout the several views and wherein.

DESCRIPTION OF THE INVENTION

Figure 1:
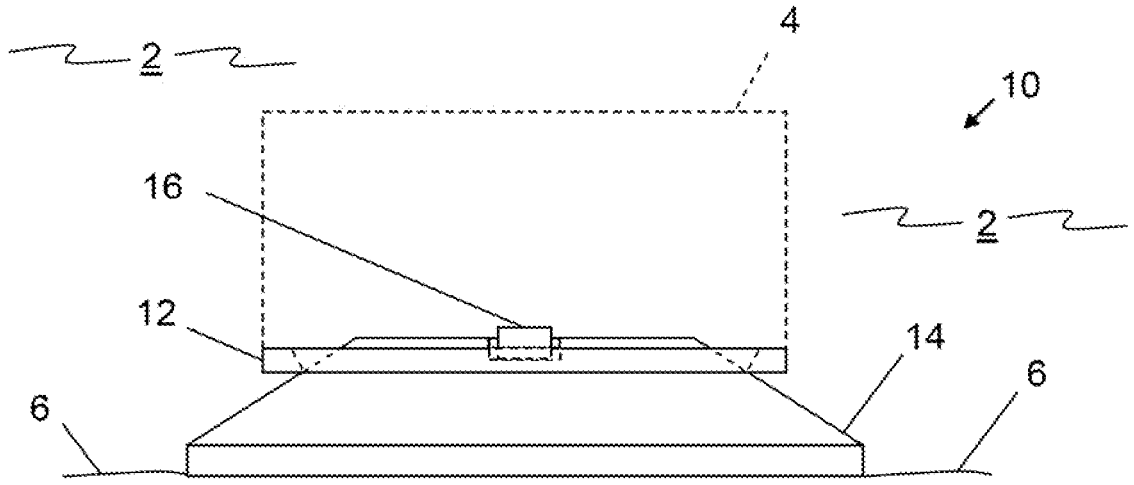
FIG. 1 illustrates a schematic side view of a controlled corrosion release system.

Referring now to FIG. 1, there is shown a schematic side view of controlled corrosion release system 10 deployed within conductive medium 2, such as seawater. In the illustrated embodiment, payload 4 is buoyant and housing 14 is negatively buoyant and capable of holding payload 4 submerged in medium 2. Thus, when payload 4 is released, it will rise to the surface of the sea for easy recovery. However, it should be understood that payload 4 need not be buoyant and housing 14 need not be negatively buoyant to remain within the scope of the present invention. For example, payload 4 and/or housing 14 may be positively, negatively, or neutrally buoyant without departing from the scope of the invention, as discussed later hereinbelow.

In the preferred embodiment illustrated in FIG. 1, buoyant payload 4 (shown dashed in FIG. 1) is attached to retaining ring 12. As will be described in further detail hereinafter, retaining ring 12 is secured against housing 14. Housing 14 is weighted such that system 10 together with payload 4 is negatively buoyant and rests on bottom 6 of medium 2.

Figure 2:
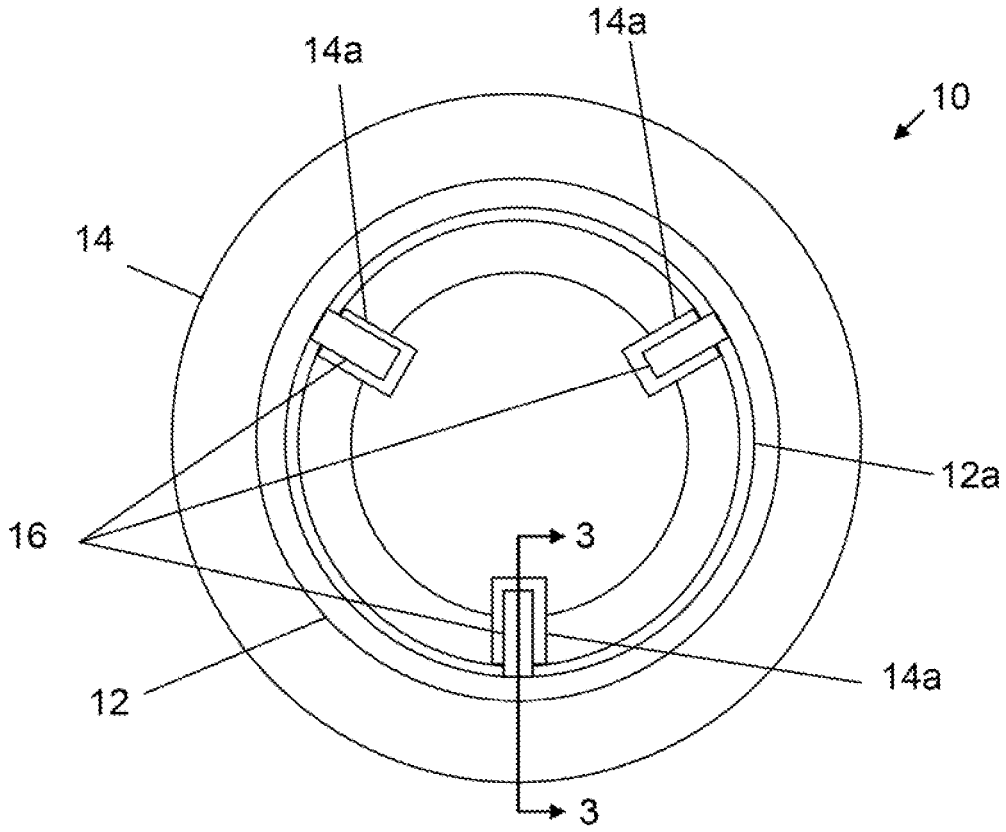
FIG. 2 illustrates a schematic top view of a controlled corrosion release system.
Figure 3:
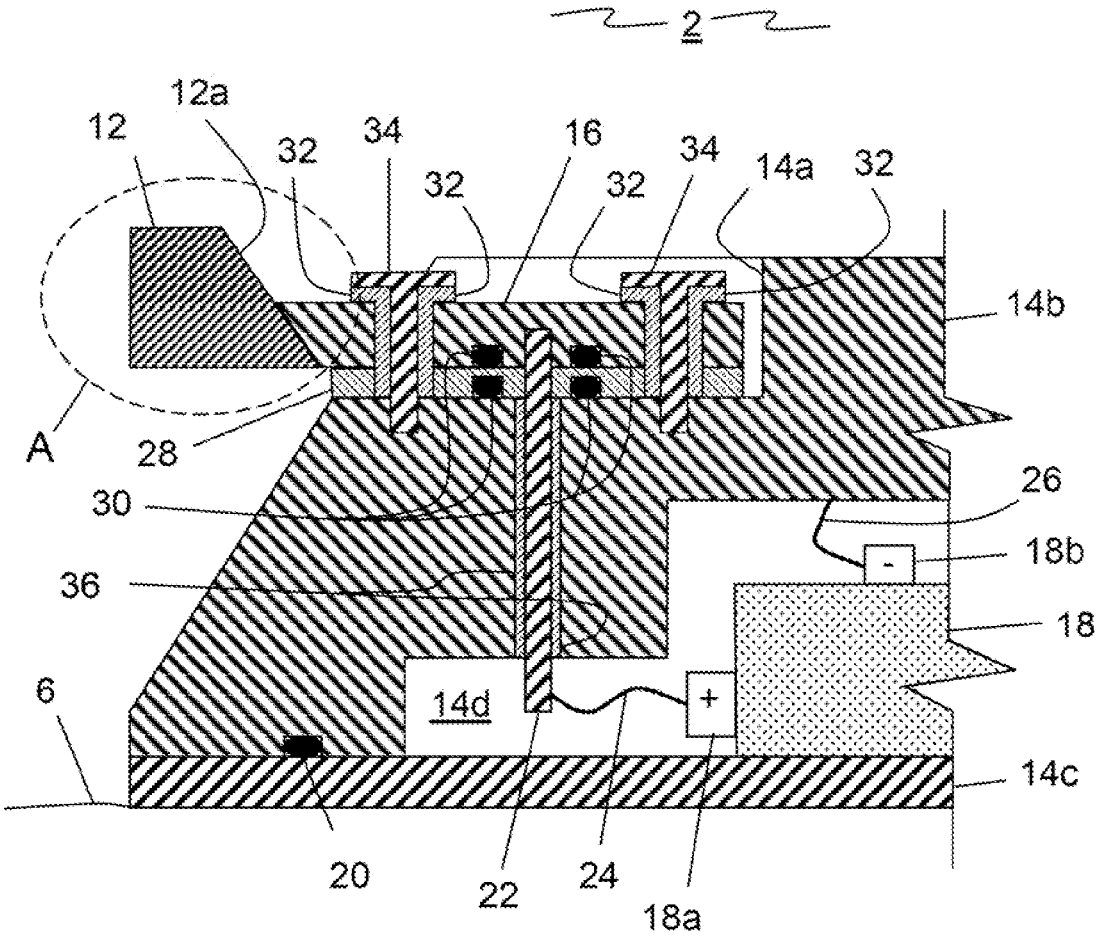
FIG. 3 illustrates a cross-sectional view of the release system of FIG. 2, taken at line 3-3 of FIG. 2.

Referring now to FIG. 2, there is shown a schematic top view of controlled corrosion release system 10. Retaining ring 12 is secured against housing 14 by clips 16. Referring also to FIG. 3, there is shown a partial cross-sectional view of system 10, taken at line 3-3 of FIG. 2. For clarity of illustration, but not limitation, payload 4 is not shown in FIGS. 2 and 3. In FIGS. 1, 2 and 3, clips 16 are illustrated as being recessed into cutouts 14*a* of housing 14.

Power module 18 is fixed within body 14*b* of housing 14. Lid 14*c* of housing 14 attaches to body 14*b* and, with o-ring 20, forms a watertight seal against body 14*b*. Conductive rod 22 is attached to clip 16 and penetrates through body 14*b* into cavity 14*d* formed between body 14*b* and lid 14*c*. Wiring 24 connects clip 16 to positive terminal 18*a* of power module 18 via conductive rod 22.

Current flows from module 18, through wiring 24, into rod 22 and to clip 16. Current flows from clip 16 through medium 2 surrounding system 10 to body 14*b* and returns to negative terminal 18*b* of module 18 via connection 26. Thus, clip 16 serves as an anode and body 14*b* serves as a cathode in the circuit. Accordingly, and in the manner known in the art, clip 16 is oxidized and corrodes in conductive medium 2 when current flows as described hereinbefore. When clip 16 is sufficiently corroded, retaining ring 12 is released. In an exemplary embodiment, the anode (i.e., clip 16) is comprised of aluminum and the cathode (i.e., body 14*b*) is comprised of stainless steel.

In order for current to flow through medium 2 from anode clip 16 and then to cathode body 14*b*, clip 16 must be electrically isolated from direct contact with body 14*b*. Accordingly first insulating material 28 is placed between clip 16 and body 14*b*. O-rings 30 prevent intrusion of medium 2 into cavity 14*d* adjacent rod 22.

Additionally, second insulating material 32 surrounds fasteners 34, which attach clip 16 to body 14*b*. Further, third insulating material 36 surrounds rod 22 as it penetrates through body 14*b*. To prevent unintended corrosion of retaining ring 12, face 12*a* of retaining ring 12, which abuts clip 12, is formed of an insulating material.

Figure 4:
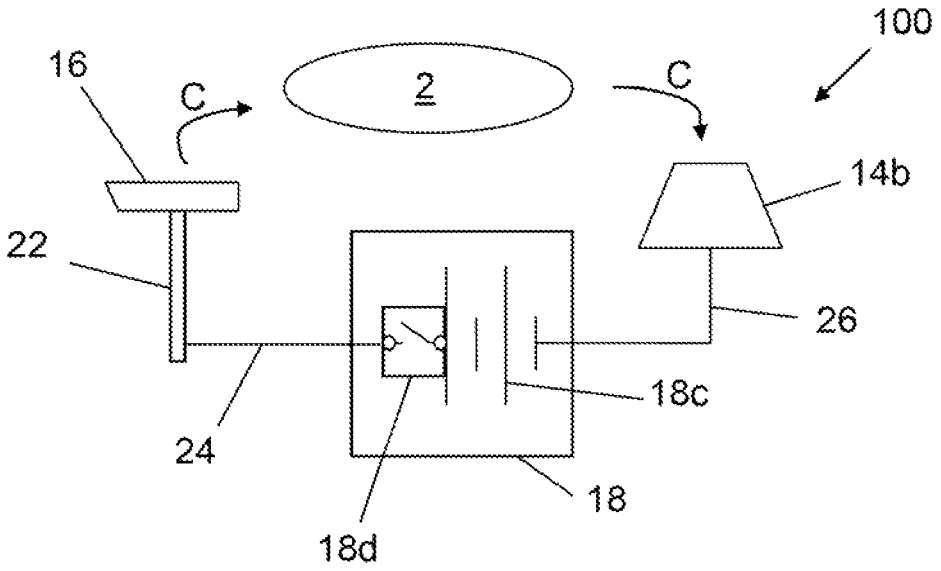
FIG. 4 illustrates a schematic wiring diagram of the system of FIG. 1.

Referring to FIG. 4, there is shown a schematic wiring diagram of circuit 100 formed by module 18, wiring 24, rod 22, clip 16, medium 2, body 14*b* and connection 26. In addition to power source 18*c*, module 18 includes controller 18*d* in communication with an operator (not shown). When the operator provides a release signal to controller 18*d*, controller 18*d* initiates the current flow described hereinbefore, in the direction illustrated by arrows C in FIG. 4.

As is known to those of skill in the art, the time for release depends on a number of factors, including, but not limited to, the power supplied, the surface area of clip 16 exposed to medium 2, the quantity of material that needs to be corroded to effect the release, and the buoyancy of payload 4. These factors can be controlled such that the time for release can be determined for a specific design.

Figure 5:
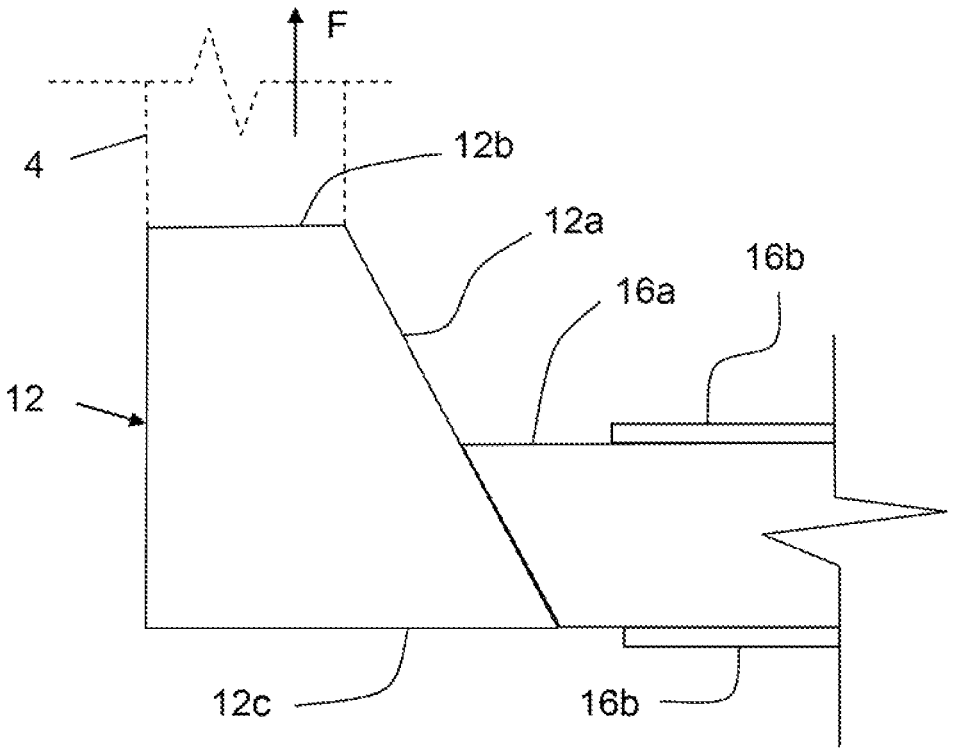
FIG. 5 illustrates a detailed view of a clip for the system of FIG. 1, taken at area A of FIG. 3.

Referring now to FIG. 5, there is shown a detailed view of retaining ring 12 and end portion 16*a* of clip 16, taken at area A of FIG. 3. For clarity of illustration, cross-hatching is omitted from FIG. 5. Face 12*a* of retaining ring 12 is sloped such that top edge 12*b* has a greater interior radius than lower edge 12*c*. End portion 16*a* of clip 16 has a slope complementary to that of face 12*a*, such that retaining ring 12 closely abuts clip 16.

The power required to corrode clip 16 depends on the surface area of clip 16 exposed to medium 2. To reduce the power required to release retaining ring 12, corrosion of clip 16 can be concentrated at end portion 16*a*. To that end, non-conductive coating 16*b* is applied to clip 16 except at end portion 16*a*.

When the release signal is given, current flows and end portion 16*a* begins to corrode. As end portion 16*a* corrodes, the strength of end portion 16*a* holding payload 4 against a separation force, or buoyant force, F of payload 4 is diminished. After the determined or designed release time period, the strength is no longer adequate to resist force F and retaining ring 12 and payload 4 are released.

Obviously many modifications and variations of the present invention may become apparent in light of the above teachings. For example, FIG. 2 illustrates three clips 16 holding retaining ring 12. The number of clips 16 can be varied to accommodate the design of payload 4 and as few as one clip could be used, where appropriate. Note that the power required to corrode anode clips 16 increases with an increasing number of clips 16.

To lessen the power requirements for the configuration of FIG. 2, not all clips 16 need to function as anodes. For example, in the illustrated example using three clips, only two of the three clips 16 need to corrode to effectively release payload 4. Buoyant force F can provide sufficient lifting force such that face 12*a* of retaining ring 12 can slide up end portion 16*a* of non-corroding clip 16. Various means can be taken to ensure that one such clip 16 is non-corroding, including, but not limited to, not providing power to non-corroding clip 16, or fully covering non-corroding clip 16 with non-conductive coating 16*b*.

Additionally, face 12*a* of retaining ring 12 is described with respect to FIG. 3 as being formed of insulating material. Those of skill in the art will recognize that retaining ring 12 itself can be formed of an insulating material, without the need for having its face 12*a* formed of a separate insulating material. Similarly, fasteners 34 may also be formed of an insulating material, without the need for separate second insulating material 32. Further, insulating coatings can be used on rod 22 and fasteners 34 in lieu of third insulating material 36 and second insulating material 32, respectively.

In a further alternate configuration, clips 16 need not be recessed in cutouts 14*a*. Also, clips 16 can be fabricated with slotted bores therethrough for fasteners 34. With this configuration, clips 16 can be radially adjusted to firmly abut against face 12*a* of retaining ring 12. Still further, controller 18*d* can be in communication with payload 4 to receive the release command. Additionally, the shape of housing 14 can vary from the round or frustoconical shape illustrated in FIGS. 1-4.

Figure 6:
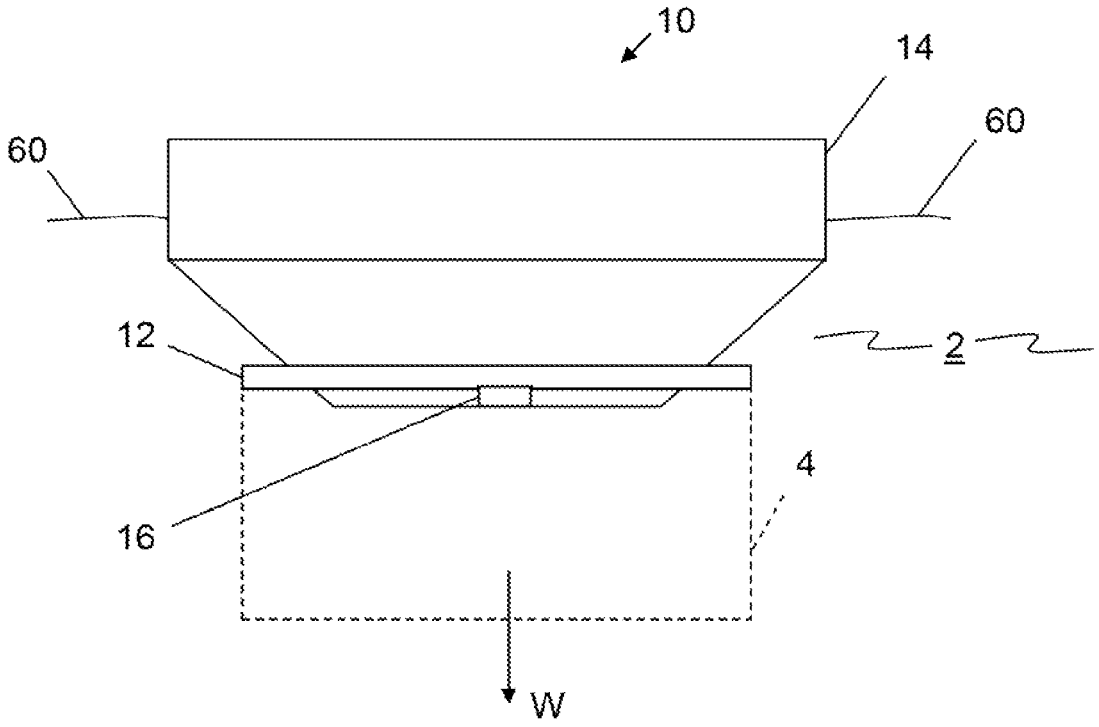
FIG. 6 illustrates a schematic side view of an alternate embodiment of a controlled corrosion release system having a buoyant housing and negatively buoyant payload.

In another embodiment, payload 4 and retaining ring 12 can be separated from housing 14 by a separation force other than buoyant force F. For example, payload 4 can be negatively buoyant and housing 14 can be positively buoyant to maintain payload at the surface 60 of the sea, as illustrated in FIG. 6. Thus, when clips 16 corrode and no longer have the strength to resist the force W caused by the negative buoyancy of payload 4, payload 4 and retaining ring 12 are released and allowed to sink to the seafloor.

It will be understood that many additional changes in details, materials, steps, and arrangements of parts which have been described herein and illustrated in order to explain the nature of the invention, may be made by those skilled in the art within the principle and scope of the invention as expressed in the appended claims.

What is claimed is:

1. A payload release system, comprising:

a housing;

a clip attached to said housing, said clip comprising an anode;

a retaining ring secured to said clip, said retaining ring being configured to secure the payload to said retaining ring, said housing capable of maintaining the payload submerged in a medium;

a power source contained within said housing, a positive terminal of said power source connected to said anode, a negative terminal of said power source connected to said housing, wherein said power source, said anode, said medium, and said housing form a circuit, and wherein said housing is a cathode in said circuit; and a controller disposed within said circuit and operable to modulate a current in said circuit in response to a release signal, wherein the rate of corrosion of said anode is proportional to the magnitude of said current.

2. The system of claim 1, wherein, in an absence of said medium, said anode is electrically isolated from said housing.

3. The system of claim 2, wherein said anode comprises an insulating material covering said anode, and wherein an end portion of said anode abutting said retaining ring is not covered by said insulating material.

4. The system of claim 3, wherein said end portion comprises a sloped face, said sloped face abutting a complementary sloped face of said retaining ring.

5. The system of claim 3, wherein said end portion overlaps said retaining ring in resistance to a separation force applied by the payload.

6. The system of claim 5, wherein said end portion comprises a sloped face, said sloped face abutting a complementary sloped face of said retaining ring.

7. The system of claim 2, wherein said housing further comprises:

a body portion, said clip being attached to said body portion of said housing; and a lid, said power source contained within a cavity formed between said body portion and said lid, said lid sealed against said body portion and sealed against intrusion of said medium into said cavity.

8. The system of claim 7, further comprising a connection element attached to said anode, said connection element penetrating through said body portion into said cavity and connecting to said positive terminal.

9. The system of claim 8, further comprising an insulating layer secured between said anode and said body portion.

10. The system of claim 1, wherein said anode is comprised of aluminum and said housing is comprised of stainless steel.

11. A controlled corrosion buoyant payload release system, comprising:

a housing having a negative buoyancy in a liquid medium;

a clip attached to said housing and configured to secure the payload, said clip comprising an anode, said negative buoyancy of said housing maintaining the buoyant payload submerged in said medium;

a power source contained within said housing, a positive terminal of said power source connected to said anode, a negative terminal of said power source connected to said housing, wherein, in an absence of said medium, said anode is electrically isolated from said housing; and a controller, wherein the rate of corrosion of said anode is proportional to the magnitude of a current modulated by said controller in response to a release signal received by said controller, said current flowing from said positive terminal through said anode, through said medium, through said housing and returning to said negative terminal.

12. The system of claim 11, wherein said housing further comprises:

a body portion, said clip being attached to said body portion of said housing; and a lid, said power source contained within a cavity formed between said body portion and said lid, said lid sealed against said body portion and sealed against intrusion of said medium into said cavity.

13. The system of claim 12, further comprising a connection element attached to said anode, said connection element penetrating through said body portion into said cavity and connecting to said positive terminal.

14. The system of claim 13, wherein said clip further comprises an end portion having a sloped face, said sloped face overlapping a complementary sloped face of the payload in resistance to a buoyancy force of the payload.

15. The system of claim 14, wherein said anode comprises an insulating material covering said anode, and wherein said end portion is not covered by said insulating material.

16. The system of claim 12, further comprising an insulating layer secured between said anode and said body portion.

17. The system of claim 13, further comprising an insulating layer secured between said anode and said body portion.

18. The system of claim 17, further comprising:

a first seal about said connection element and disposed between said anode and said insulating layer; and a second seal about said connection element and disposed between said insulating layer and said body portion, said first and second seals preventing intrusion of said medium about said connection element and into said cavity.

19. The system of claim 11, wherein said anode is comprised of aluminum and said housing is comprised of stainless steel.

* * * * *